US005897163A

United States Patent [19]

Singer

[11] Patent Number: 5,897,163

[45] Date of Patent: Apr. 27, 1999

[54] SUNTANNING APPARATUS

[76] Inventor: Andrew Singer, 506 Passaic Ave., Passaic, N.J. 07055

[21] Appl. No.: 08/905,039

[22] Filed: Aug. 1, 1997

[51] Int. Cl.[6] ..... A47C 7/62

[52] U.S. Cl. ..... 297/217.7; 297/217.3; 297/248; 297/344.21

[58] Field of Search ..... 297/217.7, 217.1, 297/344.21, 344.23, 344.26, 217.3, 188.01, 248, 232; 5/656; 607/95

[56] References Cited

U.S. PATENT DOCUMENTS

| | | |
|---|---|---|
| 2,650,647 | 9/1953 | Macknight . |
| 2,834,351 | 5/1958 | Garson . |
| 4,379,588 | 4/1983 | Speice . |
| 4,441,220 | 4/1984 | Peterson . |
| 4,597,119 | 7/1986 | Padgett . |
| 4,720,140 | 1/1988 | Change, III . |
| 5,046,782 | 9/1991 | Lundeen . |
| 5,064,244 | 11/1991 | Sproule . |
| 5,078,451 | 1/1992 | Sobel . |
| 5,211,172 | 5/1993 | McGuane et al. . |
| 5,588,697 | 12/1996 | Yoshida et al. . |
| 5,690,385 | 11/1997 | Feldman et al. . |

*Primary Examiner*—Milton Nelson, Jr.
*Attorney, Agent, or Firm*—Richard A. Joel, Esq.

[57] ABSTRACT

A suntanning apparatus comprises a plurality of chairs preferably of the lounge type which are mounted on a rotating platform which follows the sun's path. The platform rotates in accordance with a predetermined program and can vary in size to accommodate a predetermined plurality of lounge chairs. The platform is driven by a motor which is coupled to the platform to rotate the platform about a central axis. The motor is coupled to a computer which determines the movement of the platform so that the chairs are always facing towards the sun. In an alternate embodiment, a pair of lounge chairs are mounted on a rotatable platform with controls mounted therebetween for individuals to operate the drive motor to rotate the platform in accordance with the sun's rays.

7 Claims, 2 Drawing Sheets

SUNTANNING APPARATUS

BACKGROUND OF THE INVENTION

One of the problems associated with suntanning is the fact that the sun moves throughout the day necessitating movement of lounge chairs to catch the proper angle of the sun's rays. At resorts, this can result in a chaotic arrangement of chairs and disagreements as some individuals move their chairs at interval and others stay put. Another disadvantage is the fact that individuals receive an uneven tan if they fail to move their chairs.

The prior art discloses various apparatus to facilitate tanning including U.S. Pat. No. 4,140,128 to Van Der Schaaf which discloses a suntanning table which is mounted to rotate continuously through 360° relative to the base. The table purportedly permits an individual to achieve a uniform suntan and to avoid sunburn.

U.S. Pat. No. 4,379,588 to Speice discloses a revolving solar lounger which permits a sunbather to adjust his relationship to the sun's rays by powering a motor which rotates the lounger. The lounger includes photovoltaic solar cells which generate electric current in response to direct exposure to the sun's rays. Thus, the chair turns intermittently on days when the sun is intermittent.

U.S. Pat. No. 5,395,157 to Rollo discloses a rotatable suntanning chair having a frame mounted on a rotatable track while U.S. Pat. No. 5,572,316 to Zanffanella relates to an analog sun sensor which provides continuous positional information for an orbiting body such as a spacecraft.

Other patents of interest including U.S. Pat. No. 4,874,938 to Chuang; U.S. Pat. No. 4,320,288 to Schlarlack; and, U.S. Pat. No. 5,437,495. The prior art also includes U.S. Pat. Nos. 4,008,500; 5,489,142; and, 3,191,594.

The foregoing patents disclose various sun tracking means and chair rotating means. However, none of the patents disclose the specific, unique characteristics and features of applicant's invention.

SUMMARY OF THE INVENTION

This invention relates to suntanning apparatus and in particular to apparatus which automatically rotates with the sun so that the tanner is always facing directly towards the sun or in a predetermined desired position with respect to the sun. The apparatus includes a rotating platform having lounge chairs positioned thereon. This platform is coupled at its center or axis to an axial bearing while drive means rotates the platform about the axis pursuant to a predetermined program or dependent upon the sun light which is sensed by a controller. The rotatable platform is coupled to a motor which is controlled by a computer or light sensor. Thus it is possible to continuously rotate the lounge chairs on the platform so that they are always positioned appropriately with regard to the sun's rays for optimum tanning.

Accordingly, an object of this invention is to provide a new and improved suntanning apparatus wherein the user is always directed in a desired position towards the sun while seated on a lounge chair.

Another object of this invention is to provide a new and improved suntanning apparatus wherein the position of the user's lounge chair is automatically adjusted relative to the path of the sun.

A further object of this invention is to provide a new and improved suntanning apparatus which senses the position of the sun and automatically rotates the position of a lounge chair in accordance therewith.

A still further object of this invention is to provide a new and improved suntanning apparatus wherein a plurality of chairs are positioned on a platform which is rotatable in accordance with the position of the sun as determined by a computer program.

A more specific object of this invention is to provide a new and improved suntanning apparatus wherein a platform having a plurality of lounge chairs is mounted on a support coupled by spokes to an axial bearing about which the chain driven support rotates upon input from a controller.

BRIEF DESCRIPTION OF THE DRAWINGS

The above and other objects and advantages of this invention may be more clearly seen when viewed in conjunction with the accompanying drawings wherein:

FIG. 1 discloses a cut away perspective view of the support for the platform on which rotatable lounge chairs are positioned;

FIG. 2 discloses a side view of the motor control panel and drive means with portions cut away;

FIG. 3 is a partial top view of the platform on which the lounge chairs are positioned; and, FIGS. 4*a*, 4*b* and 4*c* are illustrations of an alternate embodiment of the invention wherein

DETAILED DESCRIPTION OF THE INVENTION

Figures 1, 2, 3:
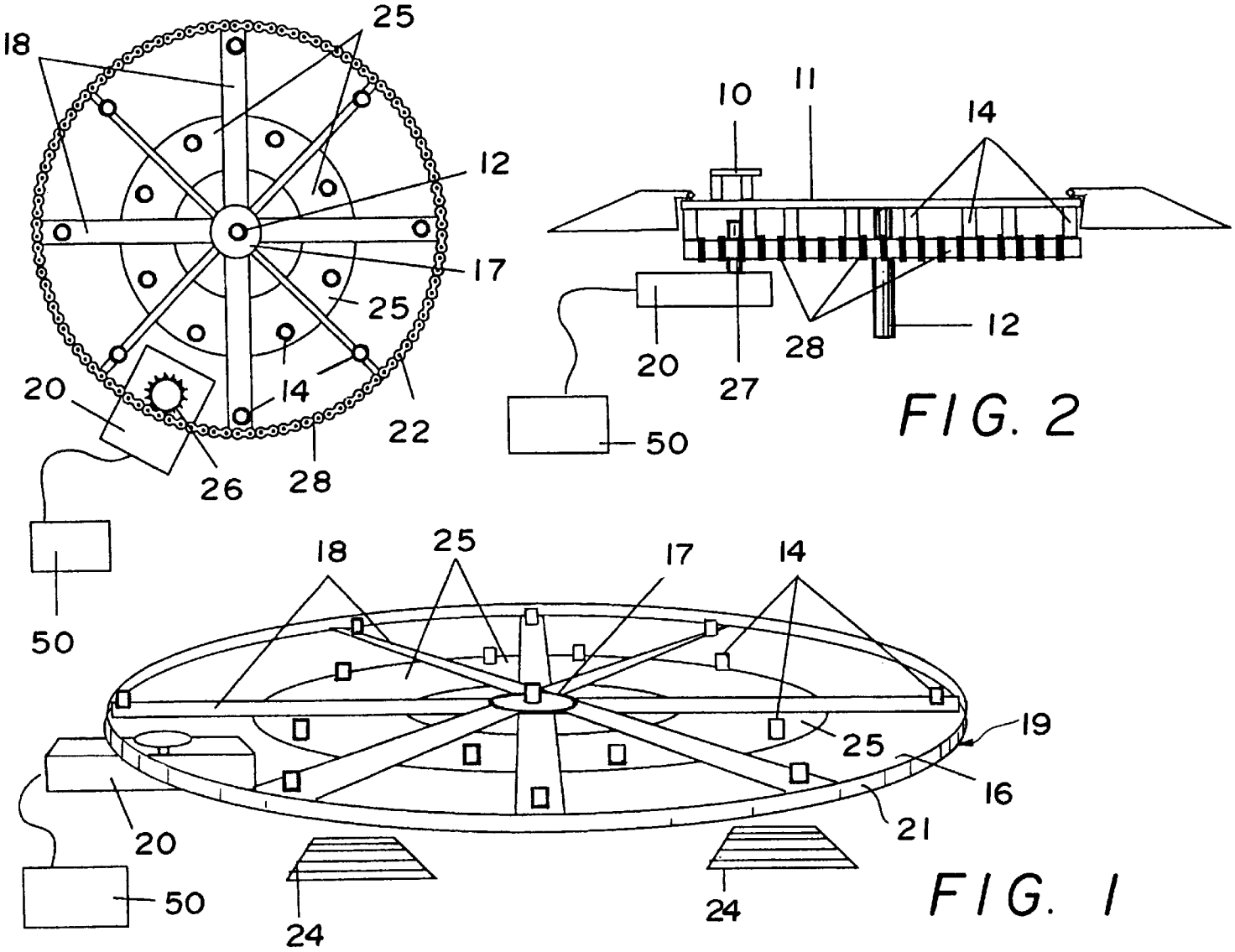
Figure 4B:
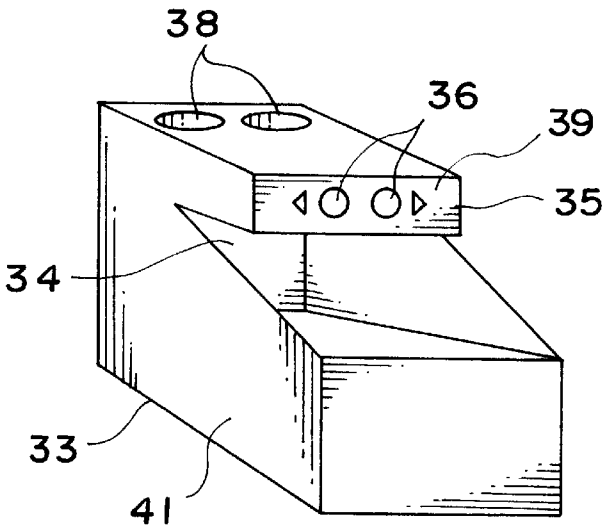
FIG. 4*b* is a perspective view of the console and FIG. 4*c* is a top view of the embodiment.
Figure 4A:
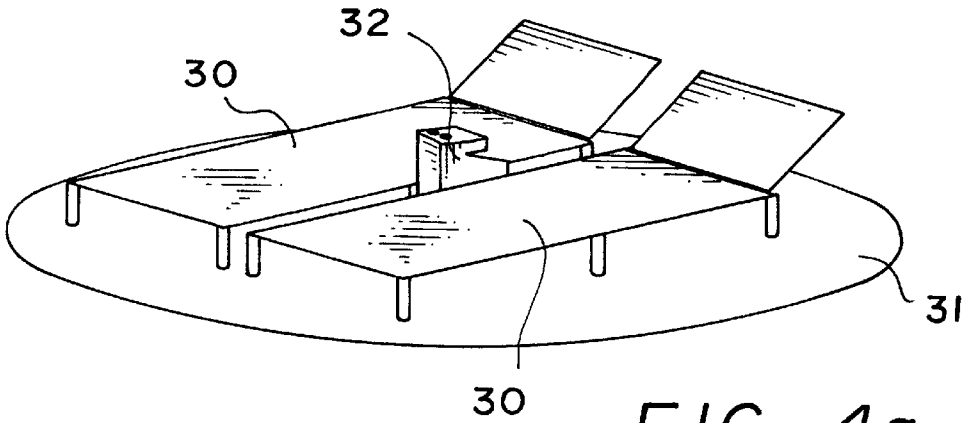
FIG. 4*a* is a view of two chairs mounted on a platform with a center control console.
Figure 4C:
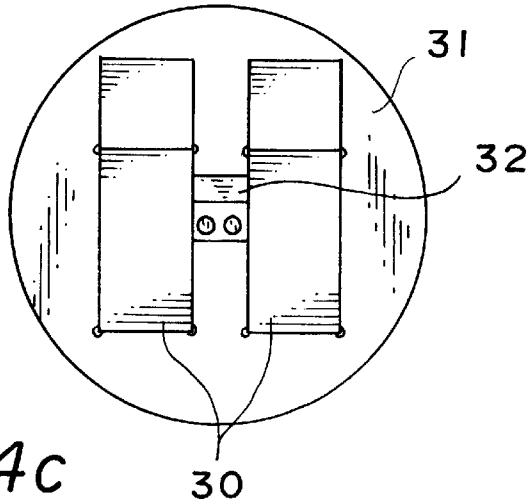

Referring now to the drawings and, in particular FIGS. 1–3, the invention comprises a plurality of lounge chairs 10 mounted on a platform 11, for rotation about a central axis 12 fixedly installed in the ground. The chairs 30 shown in FIG. 4*a*, are conventional lounge chairs and must be relocated as the sun moves about the area in order to achieve even optimum tanning. FIG. 1 is a view of the platform support 16 with the platform 11 removed to show a plurality of supports 14 for the platform 11. The platform 11 is rotatable about a central axis 12 having a bearing coupling 17. A plurality of supports or spokes 18 are coupled at one end to the axial bearing 17 and at the other end to a substantially circular ring 19 and together support the lower surface of the platform 11. The elongated spokes 18 are also joined to an intermediate ring 25 for additional support.

A motor 20 is coupled to the periphery 21 of the platform support 16 to drive the platform 11 in the desired direction and at the desired speed as determined by the control computer 50. As shown in FIGS. 2 and 3, a sprocket 26 is mounted to the drive shaft 27 of motor 20. The sprocket 26 engages links 28 on the chain 22 mounted on the exterior 21 of the circular ring 19. A motor 20 and component control panel 50 extends upwardly from the platform 11 and is coupled to the motor 20 to operate said motor 20 in accordance with a predetermined program (not shown) which insures that the lounge chair 10 always faces in a particular direction with regard to the sun. In an alternate embodiment, the motor 20 could be coupled to a drive gear (not shown) and drive the support 16 through a gearing arrangement.

In operation, the computer 50 senses the position of the sun either through a predetermined program or light sensing means. The computer 50 activates the motor 20 which drives the chain 22 through sprocket 26. The platform 11 containing the lounge chairs 10 rotates about the axis 12. Thus, the chairs need not be rearranged to follow the sun.

The system also includes one or more drains 24 which are located beneath the platform 11 in order to remove any extra fluid or other liquid which drops from the platform 11.

In the alternate embodiment of FIG. 4*a*, a pair of lounge chairs 30 are mounted on a platform 31 which rotates in accordance with instructions provided to a central console 32 located between the chairs 30. The console 32 is an attractive design with a frame 33 forming a motor housing 41 at its lower end, a storage area 34 for lotions, sunglasses, etc. and a projecting hood 35 extending over a portion of the storage area 34. The hood 35 includes control buttons 36 which, when activated, cause rotation of the platform 31 in the indicated direction. Cup holder recesses 38 may be provided in the upper surface 39 of the hood 35. This embodiment permits the individual to regulate the movement of the lounge chairs 10.

Alternatively, the rotation of the chairs 30 may be in accordance with a computer program which senses the position of the sun for the particular day of the year and maintains the chairs in an optimum position. On the other hand, a light sensor or other controller 40 may be connected to the motor 20 to drive the platform 31 in a particular direction depending on the input sunlight. This embodiment is shown in FIGS. 1–3.

While the invention has been explained by a detailed description of certain specific embodiments, it is understood that various modifications and substitutions can be made in any of them within the scope of the appended claims which are intended also to include equivalents of such embodiments.

What is claimed, is:

1. A suntanning apparatus to provide an even optimum tan comprises:

an axial support having an upper end with bearing means;

a plurality of spokes engaging the bearing means at one end and extending outwardly therefrom;

a ring having a chain mounted thereabout, said ring being engaged by the other end of the spokes;

drive means, a sprocket engaging the chain and drive means to actuate the sprocket;

support means mounted on the spokes;

a platform mounted on the support means, said platform having a plurality of lounge chairs positioned thereon; and, control means coupled to a motor for regulating the motion of the platform to maintain the chairs in an optimum tanning position.

2. A suntanning apparatus to provide an even optimum tan in accordance with claim 1 further including:

an outer ring, a circular member mounted to the spokes at an intermediate position, said circular member being located concentrically with the outer ring and having a plurality of supports extending upwardly therefrom to engage the platform.

3. A suntanning apparatus to provide an even optimum tan in accordance with claim 1 wherein:

the drive means comprises the motor and the control means comprises a computer having a program designed to move the platform in accordance with the position of the sun.

4. A suntanning apparatus to provide an even optimum tan in accordance with claim 1 further including:

a computer; and, sun light sensing means coupled to the computer to provide signals interpreted by the computer to rotate the platform.

5. A suntanning apparatus to provide an even optimum tan in accordance with claim 1 wherein:

the spokes are spaced at 45° angles from each other and the spokes total eight in number with alternate spokes being a flat elongated member and a thin bar-like member.

6. A suntanning apparatus to provide an even optimum tan in accordance with claim 1 wherein:

the control means comprises a console having activating buttons to operate the motor driving the platform.

7. A suntanning apparatus to provide an even optimum tan in accordance with claim 6 wherein:

the console includes a frame having a recess for storage and an overhang over the storage recess, said overhang including a plurality of cup holder recesses and control buttons positioned thereon.

* * * * *